United States Patent [19]

Vidal

[11] 4,301,853

[45] Nov. 24, 1981

[54] STRETCHER FOR THE MOUNTING AND STRETCHING OF A CANVAS, PARTICULARLY FOR FINE ART

[76] Inventor: Jean A. Vidal, 11 Place de la Porte Champerret, 75017 Paris, France

[21] Appl. No.: 87,140

[22] Filed: Oct. 22, 1979

[30] Foreign Application Priority Data

Oct. 24, 1978 [FR] France ..... 78 30233

[51] Int. Cl.[3] ..... A47G 5/00; E06B 9/24; D06C 3/08

[52] U.S. Cl. ..... 160/374.1; 38/102.5

[58] Field of Search ..... 38/102.1, 102.3, 102.4, 38/102.5; 160/374.1, 378, 381; 312/140; 292/256.67

[56] References Cited

U.S. PATENT DOCUMENTS 1,942,821 1/1934 Kulp ..... 38/102.3

3,949,802 4/1976 Buratovich ..... 160/374.1

*Primary Examiner*—Louis Rimrodt

*Attorney, Agent, or Firm*—Beveridge, DeGrandi, Kline and Lunsford

[57] ABSTRACT

A stretcher frame for an artist's canvas is formed of four wooden side pieces with simple mitred ends, joined at the corners by four corner connector assemblies. Each corner connector assembly has a pair of perpendicularly interconnected arms of U-shaped cross section which slidably receive two of the wooden side pieces. A support bracket projects inwardly from each arm, and a connecting bracket projects inwardly from each side piece. A threaded rod is affixed to the connecting bracket and extends through the support bracket, and a spring on the rod biases the support bracket outwardly to apply tension to a canvas on the frame. To deter inward flexing of the side pieces, cross members extend between opposed pairs of side pieces. Each cross member includes a threaded rod, a spring on the threaded rod, a tube which is biased by the spring and receives the threaded rod, and a nut which is threaded on the rod to compress the spring.

8 Claims, 5 Drawing Figures

STRETCHER FOR THE MOUNTING AND STRETCHING OF A CANVAS, PARTICULARLY FOR FINE ART

The invention concerns stretchers intended to receive and stretch a canvas, particularly painting stretchers.

These stretchers are conventionally constituted by wooden sides assembled by mitred joints with tenons and tabs of quite complicated shaping, and after positioning of the canvas, fixed to the edges of the stretcher by tacks, this canvas is stretched by driving stretching keys or corners with a hammer into the joints which lock irreversibly. However, given that the canvas itself only has a very small amount of elasticity and that it also presents variations in hygroscopicity, this means cannot ensure constant stretching of this canvas, particularly after the execution of works of art, which results in crinkling, cracking and progressive deterioration of the work of art, especially in large paintings where the stretched canvas constantly bears on the intermediate cross members which the frame generally includes.

A known way of remedying this is to make self-stretching frames whose sides are constituted by profiled lengths of light alloy jointed at the corners by special mechanical parts lodging inside the section and including springs allowing a constant tension to be exerted on the canvas, which is fixed to the sections by means of battens or clips engaging in a groove of the section, or by means of packing pieces of wood inserted in the section to allow nailing. Lastly, despite the rigidity of sections of light alloy, this does not allow intermediate cross members to be omitted for large sizes. The assembly consequently constitutes a relatively complicated and expensive solution.

The object of the invention is to produce a self-stretching frame which is far simpler than the metal solution and the wood solution while presenting the advantages of this latter.

The invention consists in producing the frame with the aid of four lengths of wood, profiled or similarly cut with mitres with no other shaping and assembling them with the aid of corner pieces in the form of right angle brackets, each of whose two perpendicular arms comprises a U-shaped section mating with the two faces and the inner edge of the corresponding section with a bracket provided with a hole on the back of this U-shaped section, while threaded rods with a fixing bracket are each fixed parallel to one of the sides of the frame near the end of this at the inner edge so that, after a nut has been engaged in this threaded rod and a compression spring engaged on the free part of the threaded rod above the nut, this threaded rod slides into the previous hole while the spring is supported by the bracket at the periphery of the hole.

For large frames necessitating intermediate cross members, simple lengths of circular tube are used, each comprising near each of its ends an inner circular flange obtained by rolling or by axial compression, and threaded rods with identical fixing brackets to the previous ones, also provided with an adjustment nut and a compression spring, these rods being fixed in this instance perpendicularly to the edge in question with the fixing bracket situated on one of the faces of the section, so that the rod engages in the corresponding end of the tube and the spring is supported by the said inner circular flange.

When two cross members of this type have to cross, one of the tubes is cut at the crossing point and the two pieces are connected by a sleeve comprising two axial blind holes receiving the two parts of the tube, and a through hole for the passage of the other tube.

Other details of the invention will appear in the following description of one embodiment taken as example and represented in the attached drawing in which.

Figure 1:
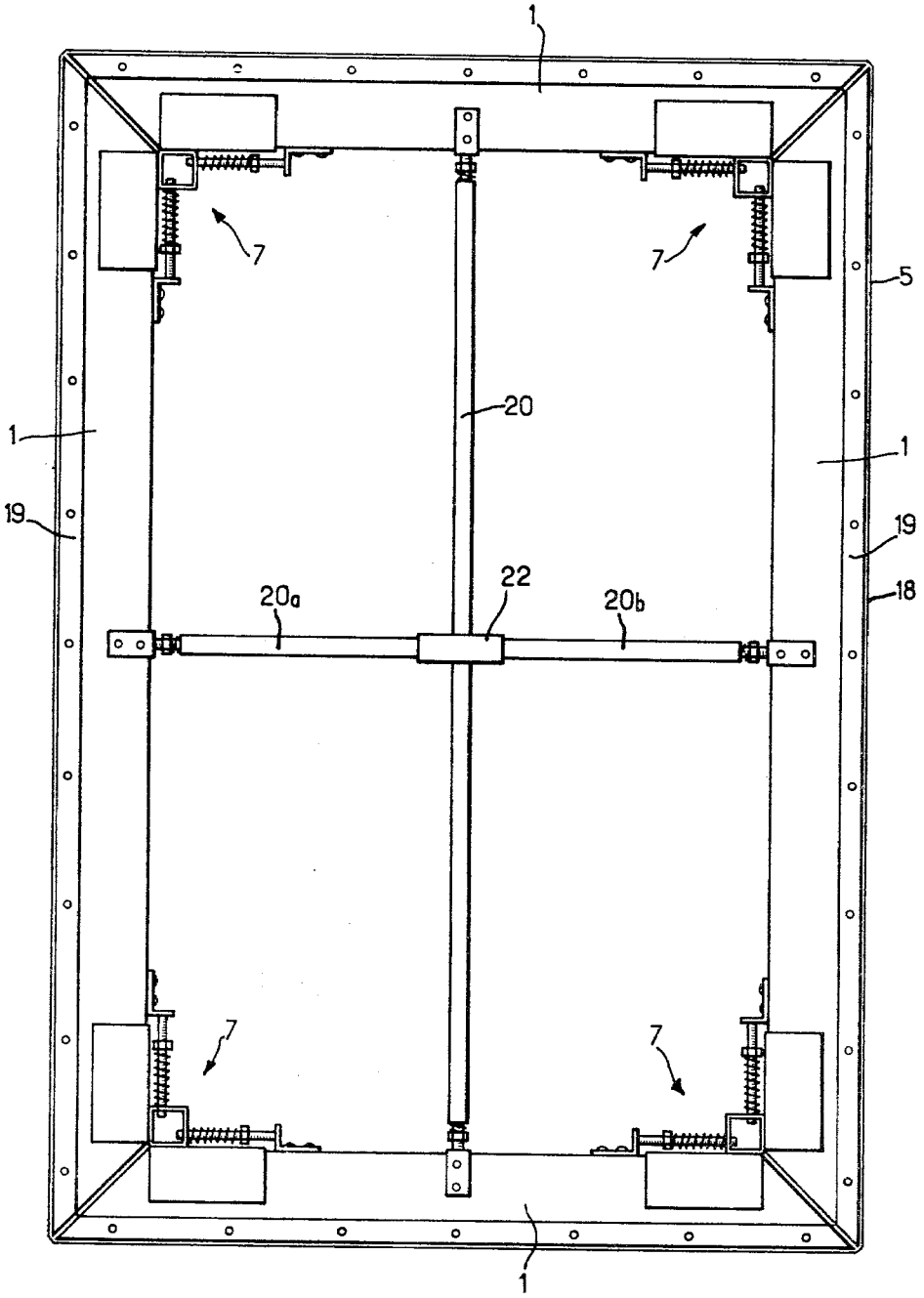
FIG. 1 is a view of the back of the convassed stretcher.

In conformance with the invention, to make the four sides of the stretcher, use is made of pieces 1 of wood with a rectangular profile, with a back face 2, a front face 3, an inner edge 4 and an outer edge 5, with, moreover, a peripheral rib 6, added or carved from the block, which forms a flange on the front face 3 along its outer contour.

Figure 3:
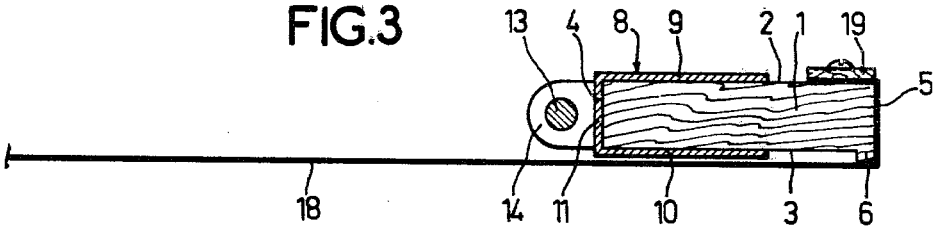
FIG. 3 is a section at III—III of FIG. 2.
Figure 2:
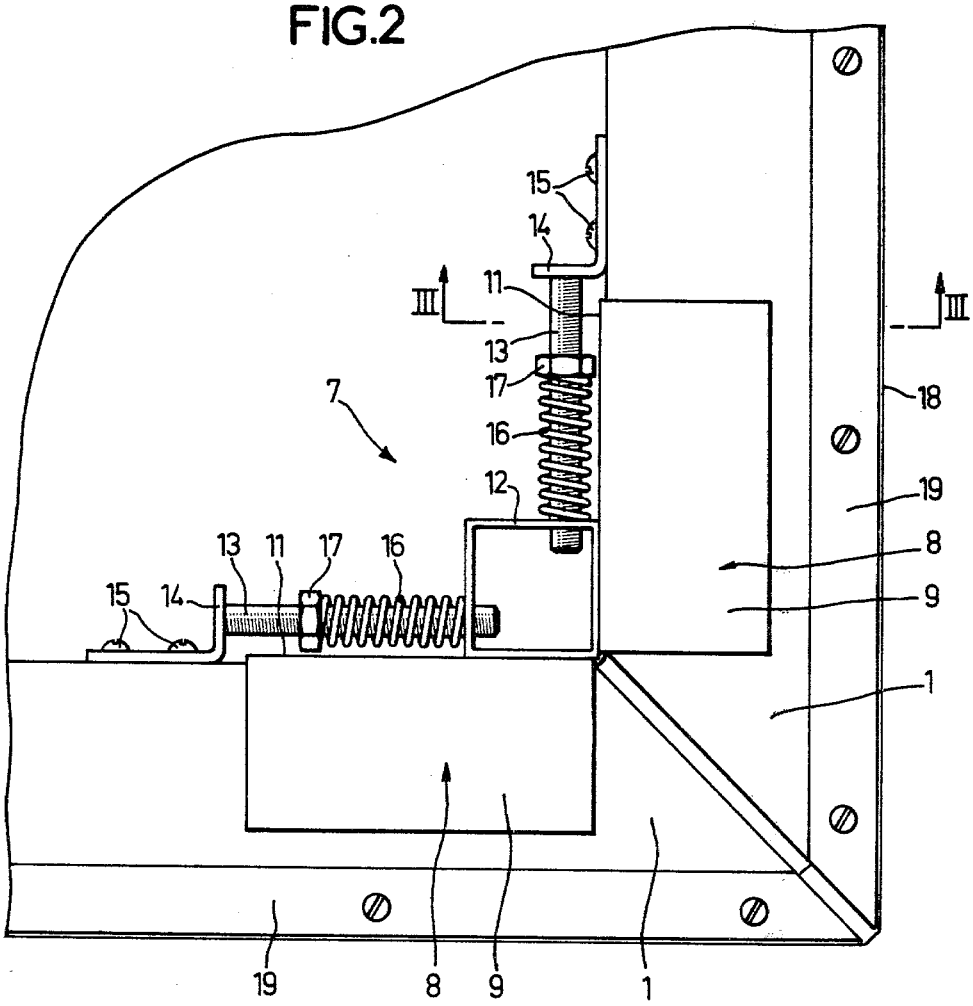
FIG. 2 represents on a larger scale the detail of assembly of one corner of FIG. 1.

The four pieces 1 of wood corresponding to the four sides of the stretcher are cut with the same section 1 and simply cut with mitres at their ends according to the dimensions required for the stretcher, with no other shaping. They are then assembled with the aid of corner timer-bonders 7 such as that represented in detail in FIG. 2. These bonders each comprise two arms 8 disposed at right angles and each provided with a U-shaped section to be seen in FIG. 3 with two parallel wings 9 and 10 mating exactly and respectively with the back face 2 and the front face 3 of the corresponding section 1, and a back 11 supported by the edge 4. In addition, each of these arms 8 includes on its back 11, in the continuous part of this or at its free end, a fixing bracket 12 provided with a smooth hole not numbered. The assembly is moreover completed by two threaded rods 13 solid with a fixing bracket 14 fixed by means of screws 15 to the inner edge 4 of the corresponding side 1 so that the threaded rod 13 extends parallel to this edge and in the direction of the corner, as represented in FIGS. 1 and 2, while passing freely into the hole of the support bracket 12. In addition, a compression spring 16 is engaged previously on the threaded rod 13 and is supported on the one hand on (an adjustment) nut 17 screwed on the rod 13, and on the other hand on the bracket at the periphery of the hole.

With this extremely simple assembly, it can be seen that the canvas 18 can be mouted in the usual way, that is to say nailed or clipped on the outer edges 5 of the stretcher, or fixed on the periphery of the back face 2, with, if need be, a batten 19, and that it is then sufficient to tighten the eight nuts 17 to produce the stretching of this canvas by an elastic stress corresponding to the adjustment of the springs 16. The peripheral flange 6, thicker than the thickness of the wings 10, prevents the canvas 18 from bearing on the face 3 and on the wing 10. The advantages of mounting on four pieces of wood are thus combined with those of metal frames but in a far simpler way and at less cost.

Figure 4:
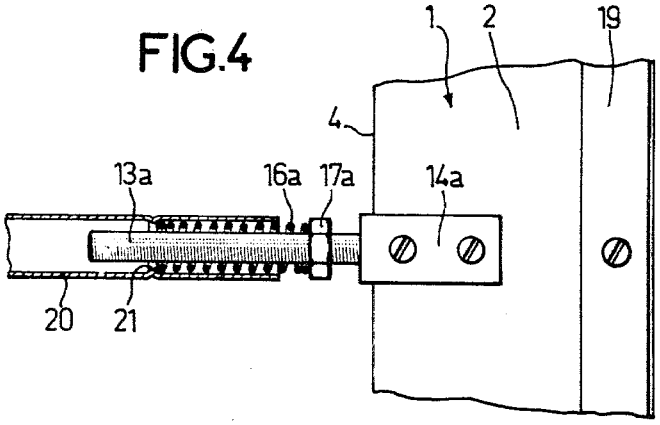
FIG. 4 represents on a larger scale and in partial section the connection of an intermediate cross member.

For frames of a certain size which necessitate intermediate cross members for preventing flexing of the sides 1, these cross members can also be made in an extremely simple way by using the same threaded rods with fixing brackets as before, as represented in FIG. 4, but disposing the rod 13*a*, identical to 13, perpendicular to the edge 4 and no longer parallel, with its fixing bracket 14*a* identical to 14 but fixed on the back face 2 of the corresponding section. As before, each of these threaded rods 13*a* includes a nut 17*a* identical to 17 and a compression spring 16*a* identical to 16. In addition, there is disposed between the two threaded rods facing one another on the two opposite sides 1, a length of tube 20, for example of aluminum, including an internal circular flange 21, obtained by rolling or by axial compression and situated a small distance from its free end. Each of the rods 13*a* passes into the tube and into the circular flange 21, while the spring 16*a* is supported by this flange. Stretching is brought about as before.

Figure 5:
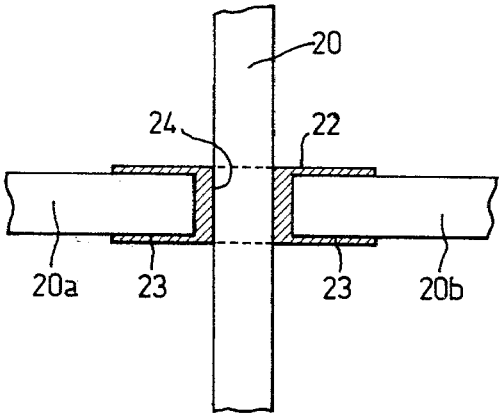
FIG. 5 represents in partial section a portion of the central part of the cross members.

In the commonest case when two of such cross members have to cross, as represented in FIG. 1, a single tube 20 as has just been shown, is used for one of the cross members, preferably the longer, and two sections 20*a* and 20*b*, connected together by a connecting sleeve 22 to be seen in FIG. 1 and represented in detail in FIG. 5, are used for the shorter, perpendicular to the previous one. This connecting sleeve 22, for example of square section, includes at each end an axial blind hole 23 allowing the fitting together of the central end of the lengths 20*a* and 26 respectively, and it includes in addition a through hole 24 allowing the free passage of the transverse tube 20. In a simplified variant, this sleeve can be constituted by a length of square tube pierced perpendicularly at its centre, in which case the uncut transverse tube 20 must be introduced first, before the lengths 20*a* and 20*b* which are supported by the previous one inside the sleeve are put in position. Consequently, we again have here extremely simple, inexpensive pieces and extremely easy mounting.

In practice, stretchers with small dimensions, up to the 146×114 size, are mounted without intermediate cross members. With stretchers of more than 6 to 7 m2, cross members and corner elements like those described are used.

Lastly, for intermediate sizes, a cheaper embodiment can be provided by using four cross members with springs 16*a* parallel in pairs and by omitting the corner springs 16, which reduces the number of springs and corresponding adjustments to eight instead of the twelve of the previous instance. The nuts 17 and the rods 13 with brackets 14 can then also be omitted, as well as, consequently, the screws 15, and the sliding hold of right angle brackets 7 on the pieces 1 of wood can be ensured in a simplified way, for example by means of a simple screw going through the backs 11 via oblong apertures cut in this.

In addition to its use for manufacturing new stretchers, the metal element of the invention can also be used to reinforce an old stretcher whose joints have deteriorated with time.

I claim:

1. A stretcher for mounting and stretching an artist's canvas, comprising, four side pieces having mitered ends, four corner connector assemblies for interconnecting the side pieces, each of said connector assemblies including a pair of perpendicularly interconnected arms of U-shaped cross section which slidably receive two of the side pieces and a pair of support brackets each of which projects inwardly from a respective one of said arms, each of said support brackets having a hole therein, a plurality of connecting brackets affixed to the side pieces and projecting inwardly therefrom, each of said connecting brackets carrying threaded rods which project into the apertures of one of the support brackets, compression springs each mounted on a rod between a support bracket and a connecting bracket, and a plurality of nuts each threadedly engaged on a rod for adjusting the biasing force exerted by the respective spring against a support bracket.

2. The stretcher of claim 1 including an intermediate cross member formed of a tube which has an internal flange near its end, a fixing bracket which is attached to the frame and is provided with a threaded rod which is perpendicular to the respective side piece, a spring which is located on the rod and has one end engaged with said circular flange, and a nut which is threaded on the rod to compress the spring.

3. The stretcher of claim 2 including cross members which meet at an intersection, a connecting sleeve at said intersection having a medial hole for the passage therethrough of a continuous tube and two axially aligned blind holes for two said tubes which extend in opposite directions from said connecting sleeve.

4. The stretcher of any one of claims 1, 2 or 3, having a piece of canvas attached thereto and tensioned thereby.

5. A stretcher for mounting and stretching an artist's canvas, comprising, four side pieces having mitered ends, four corner assemblies each including a pair of perpendicularly interconnected arms of U-shaped cross section which receive two of the side pieces and guide them for relative sliding movement, a plurality of cross members extending between each opposed pair of side pieces, each of said cross member being formed of a tube which has an internal flange near its end, a fixing bracket which is attached to the frame and is provided with a threaded rod which is perpendicular to the respective side piece, a spring which is located on the rod and has one end engaged with said internal flange, and a nut which is threaded on the rod to compress the spring.

6. The stretcher of claim 5 including cross members which meet at an intersection, a connecting sleeve at said intersection having medial hole for the passage therethrough of a continuous tube and two axially aligned blind holes for two said tubes which extend in opposite directions from said connecting sleeve.

7. The stretcher of any one of claim 5 or 6 having a piece of canvas attached thereto and tensioned thereby.

8. A stretcher for mounting and stretching an artist's canvas, comprising, four side pieces having mitered ends, four corner connector assemblies for interconnecting the side pieces, each of said connector assemblies including a pair of perpendicularly interconnected arms of U-shaped cross section which slidably receive two of the side pieces and a pair of support brackets each of which projects inwardly from a respective one of said arms, a plurality of connecting brackets affixed to the side pieces and projecting inwardly therefrom, and adjustable resilient means each mounted between a support bracket and a connecting bracket.

* * * * *